US006866447B1

(12) United States Patent
Parker

(10) Patent No.: US 6,866,447 B1
(45) Date of Patent: Mar. 15, 2005

(54) MULTI-USE FLUID COLLECTION AND TRANSPORT APPARATUS

(76) Inventor: Alton F. Parker, 16 Tracey Ct., Clifton Park, NY (US) 12065

( * ) Notice: Subject to any disclaimer, the term of this patent is extended or adjusted under 35 U.S.C. 154(b) by 0 days.

(21) Appl. No.: 10/775,459

(22) Filed: Feb. 10, 2004

Related U.S. Application Data

(63) Continuation-in-part of application No. 10/663,110, filed on Sep. 16, 2003.

(51) Int. Cl.[7] ..... E02B 11/00
(52) U.S. Cl. ..... 405/50; 405/36; 52/169.5
(58) Field of Search ..... 405/50, 43, 44, 405/45, 46, 47, 48, 49; 52/169.5

(56) References Cited

U.S. PATENT DOCUMENTS 3,965,686 A 6/1976 Saito et al.
4,019,326 A 4/1977 Herveling et al.
4,995,759 A 2/1991 Plowman et al.
5,152,892 A 10/1992 Chambers
6,527,474 B2 3/2003 Nabeshima
6,702,517 B2 * 3/2004 Goddard ..... 405/45

* cited by examiner

*Primary Examiner*—Frederick L. Lagman
(74) *Attorney, Agent, or Firm*—Schmeiser, Olsen & Watts

(57) ABSTRACT

A non-biodegradable, unitary drainage device of highly flexible character. The invention features a monolithic, sandwich construct consisting of membranous, planar top and, optional-use, bottom sheets which form a wrap/envelope or covering on a planar array of quasi-tubular supports or "stand-off "elements. Actual positioning of the supports in their planar array is varied, with parallel-interleaving, cross-lining and intertwining of supports, of either or both embodiments, being done to acquire varying degrees of strength and flexibility. Depending on specific function to be performed, the covering sheet(s) may be of differing materials, for either particulate filtering or fluid impermeability (sealing). A connection adjunct is provided that allows direct fluid communication from support(s) of one such monolith to another.

25 Claims, 5 Drawing Sheets

MULTI-USE FLUID COLLECTION AND TRANSPORT APPARATUS

CROSS-REFERENCES TO RELATED APPLICATIONS

This application is a Continuation-in-Part of U.S. patent application Ser. No. 10/663,110, filed on Sep. 16, 2003, by the same inventor, for SUBTERRANEAN DRAIN DEVICE WITH IMPROVED FILTER, and for which priority under 35 USC 119(e) and 120 is hereby claimed.

STATEMENT REGARDING FEDERALLY SPONSORED RESEARCH OR DEVELOPMENT

Not Applicable

BACKGROUND OF THE INVENTION

1. Field of the Invention

This invention relates generally to devices and constructs used to, effect subterranean drainage from building structures and entrenchments, such as walls, footings and foundations, where seepage and ground water are a problem, and also under garage and basement floors where overburden of concrete exacerbates the drainage problem by frustrating most existing devices or their filtering adjuncts. More specifically, this invention embodies a filtered drain improvement using a simplified fabric separation device that requires a far less extensive manufacturing process than the present-day art; and yet, it can sustain great overburden and is inherently pliable enough to be rolled and used as a flexible drain assembly ("blanket-drain") over and around structures that would otherwise have to be served by more cumbersome and costly systems.

2. Discussion of Relevant Art

It has long been a practice, in the construction industry, to provide some form of drainage to subterranean structures. Ground water seepage remains a problem in most non-arid regions of the world; and, building footings, garage floors (multi-level) and walls, facing surface and subsurface waters, have been most susceptible to water incursions. Many drainage devices have been provided, as well as adjuncts thereto, in order to provide adequate carry-off ("transport") of these undesired waters; some of the adjuncts provide a modicum of filtration of the minute particulate that is so common in most soils. In many cases, the filtering mechanisms must employ more than one medium of sifting-filtering material because of the varied aggregate and soil or sand mix in which the construction takes place. Until recently, the uses of prefabricated drain devices, combined with overlays of unique geo-textiles, that filter out fine particulate, did not obviate the need for vast amounts of stone to be interposed the structure and earth. Many attempts have thus been made to create drainage mechanisms that will take advantage of new materials for filtration, but nonetheless have fallen short of providing a system or assembly that has a broad spectrum of usage ("multi-usage"), such as for placement on vertical surfaces, under concrete floors (above and below ground) and for wrapping around structures such as conduits.

Five disclosures are germane to this discussion, relative to the extant art: U.S. Pat. Nos. 3,965,686 ('686), issued Jun. 29, 1976, entitled DRAIN SHEET MATERIAL; 4,995,759 ('759), issued Feb. 26, 1991, entitled DRAINAGE TUBE CONSTRUCTION; 6,527,474 ('474), issued Mar. 4, 2003, entitled PAVEMENT DRAIN; 4,019,326 ('326), issued Apr. 26, 1977, entitled NONWOVEN HORIZONTAL DRAINAGE SYSTEM; and, 5,152,892 ('892), issued Oct. 6, 1992, entitled SPIRAL FILTER ELEMENT. All of these patents show, to some degree, the functionality of the coiled or spiral element in providing a conduit for fluids and having a relatively low or limited deformation character. However, it is in the careful study of each disclosure that one perceives, albeit suitability for intended purpose, its limitations in broad spectrum applicability, as noted above.

Issued to Saito et al., '686 details a compound sheet apparatus wherein a plurality of coils or internally-strengthened tubules are parallel-arrayed, embedded in a non-woven fibrous material and disposed between two thin sheets of filter fabric. The apparatus' outer sheets are both porous and not suitable for placement against vertical walls. Most limiting is the necessity for the fibrous "filling" in which the tubules are embedded. When used for the specific purpose shown in '686, and notwithstanding the "filling", the apparatus appears to enjoy some flexibility; however, it seems intuitive that doubling the thickness of the "sandwich" would render such flexibility problematical. A characteristic of its construction, the use and dependence upon flow direction-constraining fibers, obviates a bi-directional emplacement of the apparatus on surfaces that may change in pitch direction or present a configuration that will not allow the use of a constrained-flow device.

A single-purpose drainage tube, for use in entrenchments, is shown in '759. The apparatus consists of a length of drain formed by a fixed tangential connection of parallel, equal-length sections of tubing, on a longitudinal axis that is perpendicular to the axes of the sections. The tubing consists of corrugated pipe; and, the assembly is completed by enveloping the above apparatus in a filter fabric. Although more stylized emplacements can be conceived for the apparatus, it appears that in the vertical drainage mode, turning of corners is impossible because the longitudinal fixation denies flexibility, as defined and required by the instant inventor.

Although not intended to flex, the pavement drain member of '474 is remarkable in that it is essentially a plain resin coil, albeit composed of two arcuate strands in fixed adjacency. The coil possesses a minimal gap between each annular section so as to obviate infusion of macadam, when it is set onto the asphalt medium. Water will infuse readily into the coils and be transported from the tarmac base. The primary motivation for the use of a stylized resin coil is to provide a structure having high overburden sustainability, a tunnel-like effect for transporting fluids and a possession of pseudo-homogeneity with the tarmac. The latter characteristic obviates coil interference during destruction (by grinding) of the tarmac.

The subsurface soil drainage system of '326 employs a porous mat, of non-woven fibers, in which is centrally embedded a tunnel-shaped agglomeration of heat-spun filaments of spiral or coil geometries. Subsurface waters, infusing the mat, are carried off through the tunnel of filaments, thus draining the surrounding soil. This apparatus requires a considerable thickness (and amount) of non-woven mat, making it unsuitable for the purposes of draining most structures. It also appears to lack the degree of flexibility required by the instant inventor.

Final to this review of relevant art is patent '892, for a spiral filter element possessing a special expansion-compression character. It is essentially a filter-covered spring, the coils of which are formed so that the gaps between the (analogical) annuli gradually increase in size from one coil end to the other. This predisposition of the element assures that, when vertically and operatively oriented, each discrete section of the coil is capable of sustaining the mass of the coil sections above it. Placed in a horizontal position, the spring gap variations of this element would defeat its purpose in any planar filtration ensemble.

Although for the most part, structure and soil draining, with concomitant filtration, is still performed using tiles, large amounts of stone and paper/fabric overlay (such as in drywell and septic usages), it is the instant inventor's contention that conscientious builders should transition to more effective and reliable draining and filtering modalities.

The instant invention provides an easily manipulated, flexible device that can be emplaced both adjacent to and beneath concrete structures and earthen constructs, as well wrapped about articles such as pipes, cylinders, corners and generally planar surfaces. Its use clearly obviates the need for stone, gravel and other filtering mechanisms.

INCORPORATION BY REFERENCE

Because they show both the present state of the art in drainage devices having an internally channeled structure, as well as disclosing filtering adjuncts or various stand-off mechanisms, U.S. Pat. Nos. 3,965,686, 4,995,759, and 6,527,474, with the aforesaid priority application, are hereby incorporated by reference.

Definitions

Generally throughout this disclosure, words of description and claim shall have meanings given by standard English usage; however, certain words will be used that may have a more stylistic (in bold-face) meaning and are defined as follows:

blanket-drain—a term of art used herein to refer to the assembly for, or method of, providing below grade/structure drainage using the inventor's preferred and alternate embodiments;

construct—generally, an article or a building structure;

continual—having intermittent, or periodic, breaks or discontinuities;

continuous—having no breaks or discontinuities;

continuum—suggesting a continuity of some feature, such as a covering;

cross-link—the quality of communication between support elements of the invention;

hoop—an element having a generally circular (or annular) geometry, also ring and annulus;

integral—necessary to complete or in itself complete;

longeron—a longitudinal element that connects parts of a series such as the annuli or hoops of the invention embodiments, also spar and stringer;

median—as used herein, the mean of the distance of plane change (PS) between two hoops/annuli of a coil;

membrane or membranous—of or pertaining to a porous/non-porous, thin sheet of material, irrespective of its composition—as opposed to mat or matted;

nodule—a projection of indefinite shape that can be, simply, a detent or dimple;

permeable—the quality of allowing a fluid, to pass through;

quasi-tubular—the character of a support element (in a filter assembly) that emulates a pipe or tube in that it sustains an axial void;

rigidity—a physical property of an object wherein the object substantially resists deflection in a particular dimension (direction) or plane;

sandwich—the configuration made by placing one planar surface over, but set apart from a second surface, and wherein either may be virtual or referenced as face(s);

stand-off—a spacing support element or device that facilitates the setting apart of articles;

tubule—item having a tube-like appearance;

unitary—having wholeness, as in a single unit or monolith composed of plural members.

The above listing is not exhaustive. Certain other stylized terms, used previously or hereafter, are defined at the time of their first usage or placed in quotation marks and used with conventional wording.

BRIEF SUMMARY OF THE INVENTION

The deficiencies and limitations of the earlier art, namely complexity, cost and in most instances inflexibility, are overcome by providing an inexpensive, easily applied innovation that facilitates collection and removal (transport) of subsurface or sub-structural waters. Additionally, a continued rollup or wrap-around capability of the instant drainage assembly enhances it greatly in respect of packaging and shipping, as well as use in the field.

Defined generally by a sandwich morphology, the invention consists of a planar array of strong, firm, non-biodegradable members that are, in a pristine sense, configured as supportive, stand-off elements that bear a membranous covering of geo-textile filter fabric, on at least one face of the array. Depending on the use of this relatively flexible assembly, the other face of the planar array may bear the same type of membranous covering, a non-permeable covering or no covering at all, save for an optional mesh. The latter (mesh) is employed, at a manufacturer's discretion, to enhance the structural integrity of the assembly.

Critical to the synthesis of the invention is the use of discrete elements, of a generally circular (hoop) definition. These elements are concatenated, to form a coil, or are ganged in a coaxial arrangement along a membrane, fixed thereto or integral with at least one longeron. Both of these constructs give the resultant (member) a tunnel-like or quasi-tubular shape and, when arrayed by parallel alignment or cross-linking, possess excellent flexibility, provide exceptional overburden support and facilitate fluid transport, after its passage through the overlying filter fabric.

Quasi-tubular members may be fixed to the covering(s) by any adhesive suitable for permanent, water-impervious and non-biodegradable existence; many are available throughout the automotive, construction and plastics industries.

With the invention, there is acquired not only a device that has unlimited in-ground use, with high overburden sustainability, but one retaining a high degree of flexibility that allows wrapping about an article/structure or compact rolling-up, for ease in handling, storage and shipment.

DETAILED DESCRIPTION OF THE INVENTION

Before commencing this description, the reader is referred to the DEFINITIONS, given above. The materials of construction are well known in the industry and no further mention will be made of them other than that the filter fabric is in common usage, in sheet ("membrane") and mat forms, and the support or stand-off elements may be composed of any strong, non-biodegradable resin or polymeric, such as polyamide, polyester or polyvinyl chloride. In short, the physical characteristics of the materials comprising the stand-off elements should be heat-melt formable to facilitate manufacture by extrusion, casting or injection molding processes.

Figure 1:
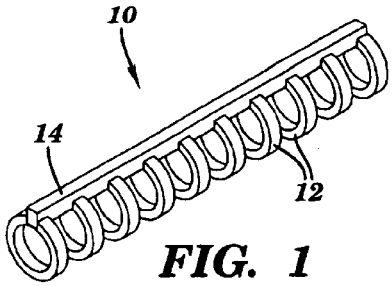
FIG. 1 is a representation of the preferred embodiment of a stand-off or support element of the invention.

Referring now to FIG. 1, there is depicted, in the preferred embodiment, a support/stand-off element 10 of the invention. It is, substantially, a quasi-tubular item comprised of a series of hoops or rings 12 that are axially aligned on and integral with a stringer/longeron 14. This element is generally produced by injection molding as a unitary item. The particular annular shape is chosen because of its resistance to deformation likely to be caused by centripetal forces, such as overburden of soil or concrete.

Figure 2:
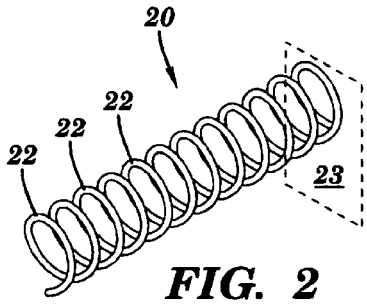
FIG. 2 a representation of an alternate to the preferred embodiment of the stand-off or support element of the invention.
Figure 3:
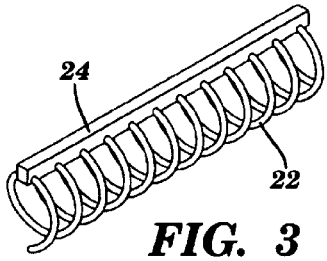
FIG. 3 is a drawing of the FIG. 2 element having a structural support, termed a longeron or stringer.

The alternate support/stand-off element is shown in FIG. 2, and is described simply as a coil 20. As is readily apparent, a series of hoops/annuli 22 are, by the nature of a coil, axially aligned, but not discretely closed. Although being made of similar material, the coil lacks the inherent strength of the preferred embodiment support 10 because there is no structure to confine any one annulus to its median plane 23. To compensate for the coil's tendency to contract or expand out of it's median plane, the FIG. 3 modification is made. There, a stringer/longeron 24, peculiar to the coil 20, is added. Whereas the coil is readily made by extrusion techniques, the element of FIG. 3 requires secondary processes that require its alternate embodiment nomenclature, in the instant invention. As was discussed in the above discussion of relevant art, a coil without an intermediate support, such as the filler medium of U.S. Pat. No. 3,965,686, will simply be unable to sustain the great overburdens anticipated in most subsurface emplacements. It is, however, desirable and used where feasible, because of its inherent flexibility—generally as a cross-linking (entwinement) element or when adequately constrained (see FIG. 7).

Figure 4:
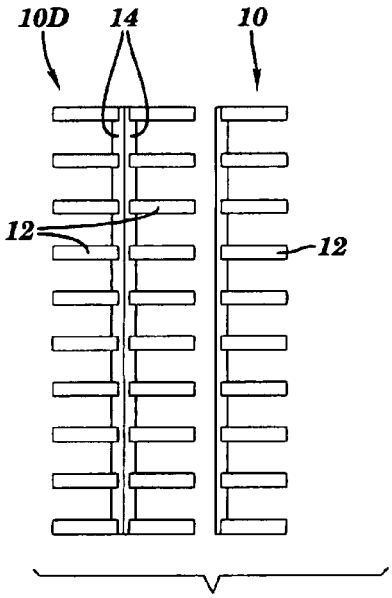
FIG. 4 is a plan view of the FIG. 1 element, in-place and adjacent a compounded version ("doublet") thereof.

FIG. 4 introduces an optional use of the support element 10D, also referred to as a "doublet". The doublet is a cohesion of two "tubule" units 10 generally, but not necessarily, along their respective longerons 14. Here, in plan view, the doublet is postured proximate the unit 10 and parallel to it. Although not shown here, the unit may be axially rotated 180° and the hoops of the unit interleaved with those of the doublet. This arrangement is known as "staggered array". It will be seen in the FIG. 12 description, concerning corner emplacements.

Figure 5:
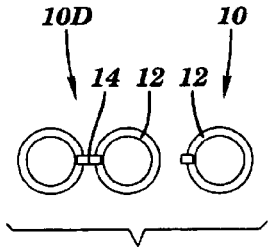
FIG. 5 is an end elevation of the FIG. 4 assembly.
Figure 6:
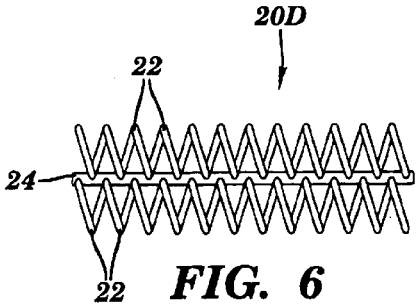
FIG. 6 is is a plan view of the FIG. 2 element, in-place and adjacent a doublet version of the FIG. 3 element.

FIG. 5 presents an end elevation of the FIG. 4 array. The elements 10/10D may be arrayed in either unit, doublet or mixed assemblage; likewise they may be in parallel, staggered or non-staggered registry, so long as a close proximity is maintained, i.e., there are no intervening or intermediate constraints, such as filler materials. FIG. 6 shows a coil doublet 20D, in plan view. It, along with its unit of FIG. 2 or 3 enjoys almost the same versatility and may be mixed with them, or with the preferred embodiment 10 in stand-off arrays.

Figure 7:
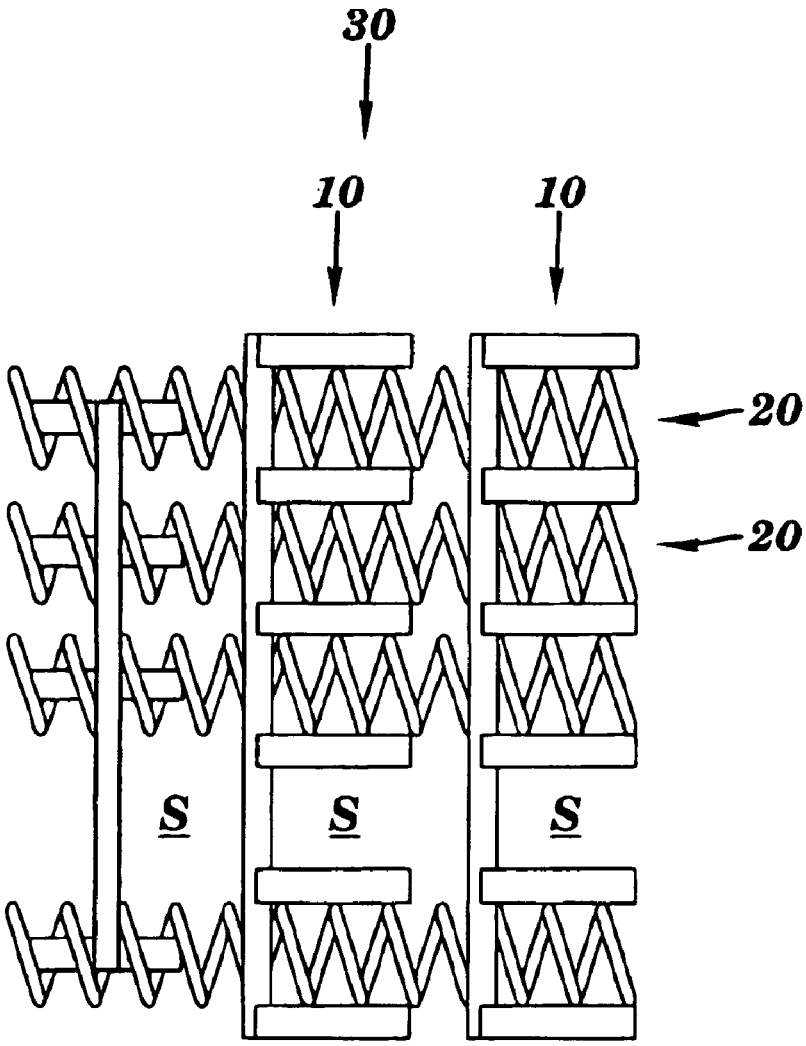
FIG. 7 is a plan view of an optional arrangement of one or both elemental embodiments of FIGS. 1–3.
Figure 8:
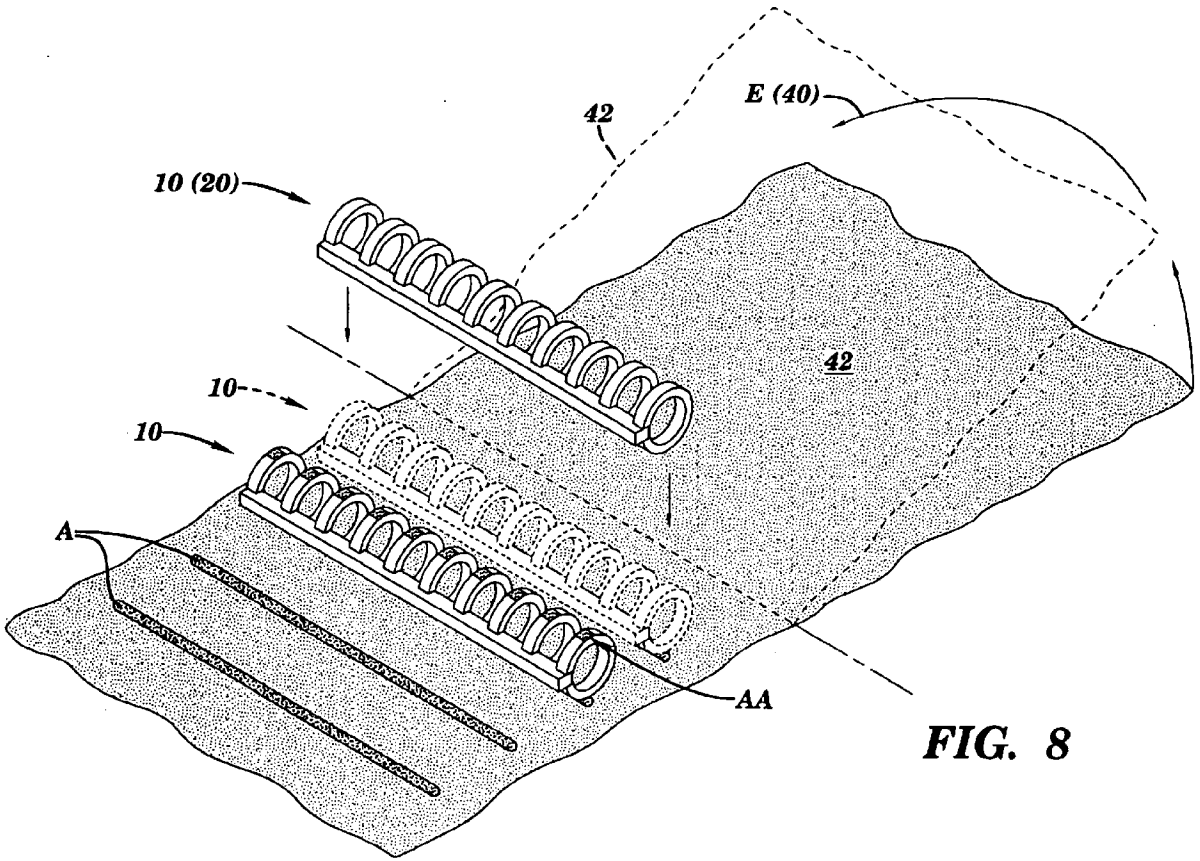
FIG. 8 is an illustration of the confection technique for a small section of the invention assembly.

The aforesaid versatility is clearly seen in FIG. 7, where a highly supportive stand-off array 30 comprised of a mix of the preferred embodiment 10, in parallel arrangement, is cross-linked with the alternate embodiment 20. The coil usage, in this array, neither uses nor requires the strengthening longeron. Other arrangements may be made of either embodiment, with the coil modality free of, or bearing, the longeron. In a production run, the actual arrangement of the hoop elements 10/20, as well as their mix and size, will be selected according to the function to be performed. For example, where a "pour through" of concrete is desired, spacing of elements to create voids in the array may be provided. A (small) model of such spacing S is depicted in the figure. Such a provision would, of course, necessitate removal and sealing of any covering, over and under the array at the selected void areas; such would be done in production or at the site of installation. From a production standpoint, FIG. 8 shows the assembly of the invention 40 (see, FIG. 9: 40) to be straight forward: (1) the desired covering membrane 42 is laid or run out to receive, along desired and discrete portions thereof, a suitable adhesive A for fixing support elements 10 (20) to it; (2) the adhesive is disposed on the membrane, in the selected array pattern; (3) the support elements are joined to the membrane on the adhesive; (4) additional adhesive AA is deposited on tops of the fixed elements; and, (5) is another layer of membrane is folded E(40) over or otherwise placed onto the ensemble to complete the assembly. Such an assembly process is familiar to manufacturers.

Figure 9:
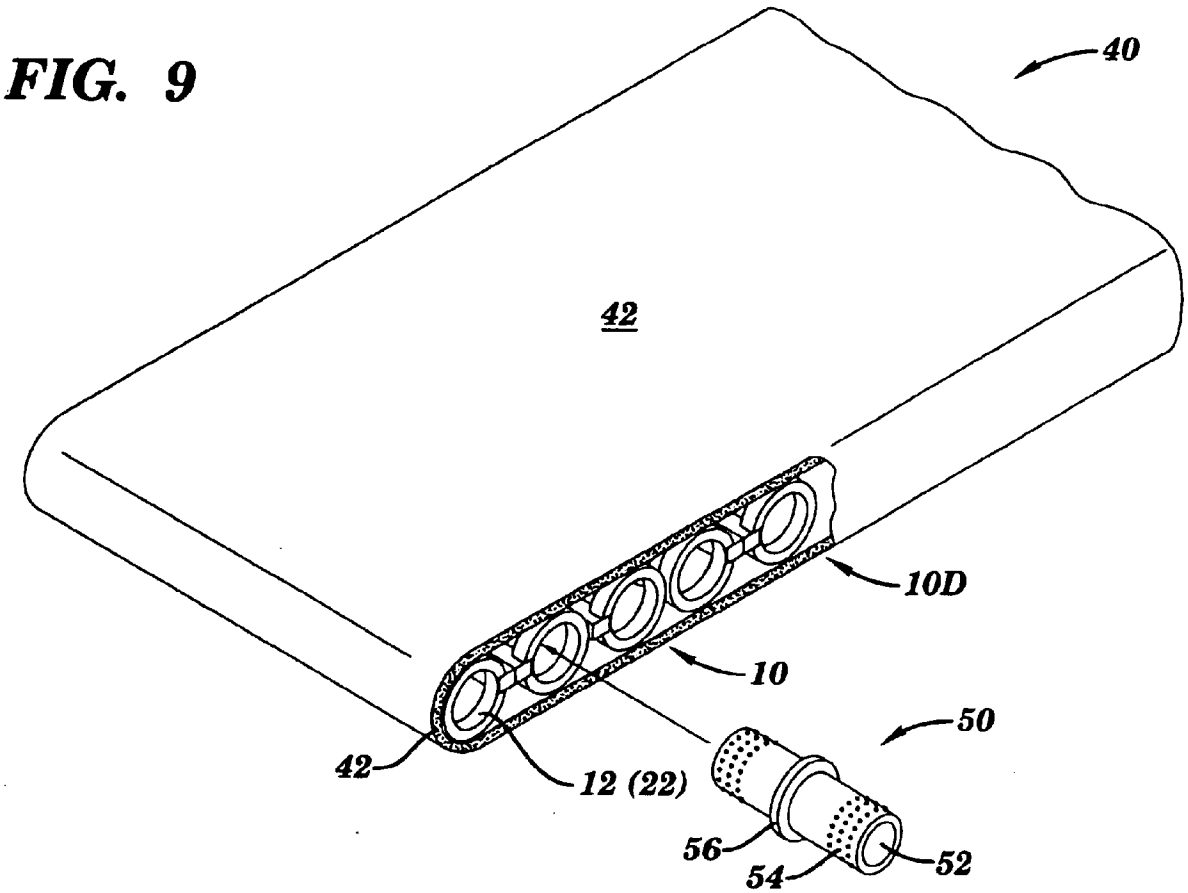
FIG. 9 is a drawing of a model of the invention, diminutive only in its surface area.

Depiction is seen, in FIG. 9, of a model of the assembled invention 40. In this partial cut-away drawing, the supports/stand-offs are a mix of the preferred embodiment, in unit 10 and doublet 10D modes. The membranous covering 42 is a geo-textile filter fabric, now used throughout the industry; it envelops the array. In some installations, and depending on the sizing of the production models, it may be desirable to concatenate the arrays of the invention 40. This being the case, a connector 50 is provided to mate a tubular element with its corresponding element in the concatenated array (not shown). The connector consists in a straight tube 52, of a plastic or resin, that is designed to fit snuggly into the tubular elements' hoops 12(22). To assure that the tubes are not easily retracted during installation manipulation, a number of detents 54 are provided around the ends of the tube. Too deep an insertion, into the element, is precluded by the presence of a flange 56, circumscribing the middle of the tube 52. In most instances of use, an installer requiring concatenation to ensure continuity of fluid passage through the arrays, need only open ends of the invention, thereby creating "flaps". Concatenation, using only a few of the connectors, can then be finished by sealing the flap ends over the adjoining assemblies. Alternatively, connectors need not be used if the covered, abutting ends of an assembly 40 are taped over with a durable, non-biodegradable adhesive or sealing tape.

Figure 10:
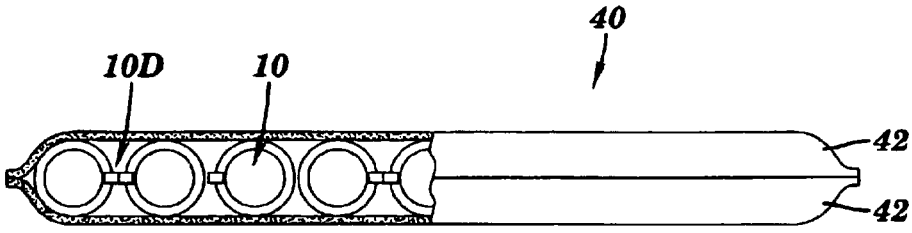
FIG. 10 is a sectionalized end elevation of the FIG. 9 model.
Figure 11:
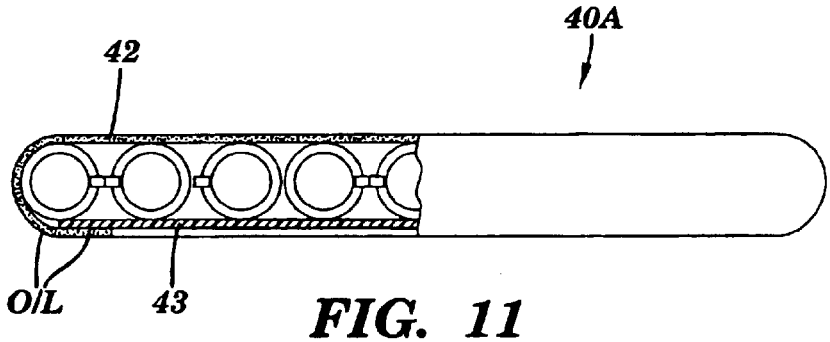
FIG. 11 is a sectionalized end elevation of the FIG. 9 model, bearing an optional partial covering; and, FIG. 12 is an end view depicting the ability of the FIG. 9 device to negotiate around-the-corner emplacement.
Figure 12:
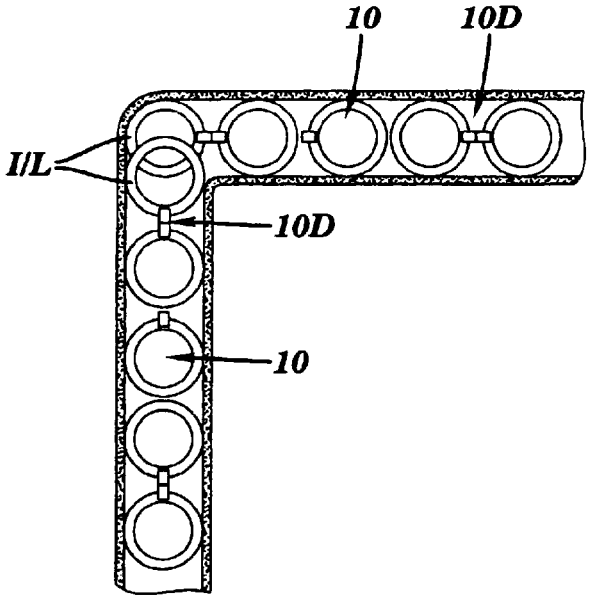

Remaining drawings, FIGS. 10–12, illustrate two options featured in the invention 40/40A, with FIGS. 10 and 11 directed to covering options, and FIG. 12, to a stand-off arrangement. It will be noted that FIG. 10 shows the invention 40 enveloped in the filter covering 42, over the top and bottom of the quasi-tubular array, comprised of unit 10 and doublet 10D elements. For the sake of clarity, no adhesive or alternate stand-off(s) are shown, in any of these remaining drawings, but it should be reckoned that any of the aforementioned features of the invention are, or could be, used.

FIG. 11 discloses another option in the invention 40A. Here, a partial membranous covering of filter fabric 42 is complemented by a non-biodegradable, water impervious membrane 43. This option finds utility, particularly, when the invention 40A is to be placed onto a surface that is to be sealed against water infusion, e.g., outside basement walls. The amount of actual overlap OIL depends on a particular usage, manufacturers preferences and the membrane bonding techniques to be used.

Final to this description, FIG. 12 shows an end elevation of the invention featuring yet another optional arrangement of stand-off/support elements 10 and 10D. The inventor's specifications call for a parallel arrangement of quasi-tubular supports in near or close proximity, that is, eschewing any filler medium between adjacent supports and yet fully contemplating a physical communication between these elements (ibid FIG. 7). In FIG. 12, the referenced optional arrangement is termed a parallel, interleaved I/L disposition. The arrangement is simply an alternating, forward-back ("staggered") placement of the supports, of either type (two doublets shown) throughout the array, in pre-selected periodicity. This option facilitates an easier traversal of the invention around a corner, thus allowing sharp turns in its placement. Of course, adjustments in either adhesive application (fixture) or membrane looseness may be necessary for such a feature; but they are well within the competence of modern manufacturers.

It should be recognized that the fundamental aspects of this invention can be realized with, for example, quasi-tubular stand-offs of different nomenclature, such as rigid, perforated pipes/tubules-but, flexibility will be lost and the quantity of subsurface water to be infused into, collected and transported by, the apparatus will be greatly diminished.

The clear advantage of using the stand-off elemental structures of the invention is seen in the fact that the gap between adjacent hoop planes (FIG. 2: 23), of either embodiment, can exceed the nominal thickness of the discrete hoops. Such advantage is not shared by the multitude of extant drain tubes. Also, reading the disclosure, one may rightly infer that the planar array (see FIG. 7) may take on any planar geometry, flex to the degree allowed by stand-off size and arrangement, and be covered by both permeable/non-permeable membranes, on either one or both faces of the array. Lastly, not merely to facilitate around-the-corner installation, as depicted in FIG. 12, the interleaved arrangement, in either embodiment 10/20, is used by the inventor to augment the support members' strength. This strengthening becomes necessary under very high overburden conditions and, as an option, provides a dual function to the interleaving practice.

Such variations are commended to the field, consistent with the appended claims.

What is claimed is:

1. A sandwich-type drainage device comprising:

a first planar, membranous element comprised of a fluid-permeable filter fabric; and a planar array of two or more adjacent and unobstructed, flexible, quasi-tubular stand-off members, wherein a stand-off member of said array comprises an in-line series of hoop devices, the array manifesting an obverse face and reverse face, said obverse face disposed on the first planar membranous element.

2. The device of claim 1, wherein said series imputing to the stand-off member a two-degree of freedom flexibility.

3. The device of claim 2, wherein said hoop devices is an open loop and said in-line series comprising a coil.

4. A sandwich-type drainage device comprising:

a first planar, membranous element comprised of a fluid-permeable filter fabric; and a planar array of two or more adjacent, flexible, quasi-tubular stand-off members, the array manifesting an obverse face and reverse face, said obverse face disposed on the first planar membranous element, further wherein a stand-off member of said planar array comprises an in-line series of hoop devices, said series imputing to the stand-off member a two-degree of freedom flexibility, further wherein said hoop devices is an open loon and said in-line series comprising a coil, further wherein said coil is adjoined to another coil by means of a common longeron running between and integral with each coil.

5. A sandwich-type drainage device comprising:

a first planar, membranous element comprised of a fluid-permeable filter fabric; and a planar array of two or more adjacent, flexible, quasi-tubular stand-off members, the array manifesting an obverse face and reverse face, said obverse face disposed on the first planar membranous element, further wherein a stand-off member of said planar array comprises an in-line series of hoop devices, said series imputing to the stand-off member a two-degree of freedom flexibility wherein said in-line series further comprises a plurality of parallel-arrayed, closed hoops in which each hoop of the plurality is jointed periodically, and is substantially orthogonal, to at least one longeron common to all said hoops.

6. The device of claim 2, wherein said planar array further comprises two or more said standoff members configured in an unobstructed, adjacent and parallel arrangement.

7. The device of claim 6, further wherein said two or more said stand-off members are in a close-proximity, interleaved positioned configuration.

8. The device of claim 2, wherein said planar array further comprises two or more said stand-off members configured orthogonal to each other.

9. The device of claim 1, further comprising a second planar membranous element overlain and adhered to the reverse face of the array of stand-of members.

10. The device of claim 9, wherein said second planar membranous element is a continuum of said first planar membranous element and completely envelopes said planar array.

11. The device of claim 9, wherein said second planar membranous element is a non-permeable, non-biodegradable membrane.

12. A subsurface fluid collection and transport assembly comprising:

an essentially loose planar array of quasi-tubular, stand-off members, said stand-off members each comprising a plurality of fixedly, axially aligned, and axially spaced circular configurations that are made of strong, substantially non-biodegradable materials, said array including at least two of said stand-off members disposed in an immediate, unobstructed adjacent relationship;

a planar geo-textile filter fabric overlying the stand-off members at an obverse face of the planar array; and a reverse side of said array supporting a covering comprised of a non-biodegradable membrane.

13. The assembly of claim 12, wherein said immediately adjacent relationship includes an interlinking of two or more supports.

14. The assembly of claim 12, wherein at least one of said filter fabric and said covering is fixedly attached to said planar array.

15. The assembly of claim 14, wherein said fixed attachment is adhesively joined.

16. A subsurface fluid collection and transport assembly comprising:

an essentially loose planar array of quasi-tubular, stand-off members, said stand-off members each comprising a plurality of fixedly and axially aligned circular configurations that are made of strong, substantially non-biodegradable materials, said array including at least two of said stand-off members disposed in an immediate, unobstructed adjacent relationship, wherein said immediately adjacent relationship comprises a parallel arraying of two or more supports that includes interleaving;

a planar geo-textile filter fabric overlying the stand-off members at an obverse face of the planar array; and a reverse side of said array supporting a covering comprised of a non-biodegradable membrane.

17. The assembly of claim 12, wherein said covering further comprises a particulate filter fixedly attached to the reverse side of said array and is a continuum of said planar geo-textile filter fabric.

18. The assembly of claim 12, wherein said covering is a non-permeable, non-biodegradable membrane.

19. A fluid collection and removal system comprising a drainage article that features a membranous, geo-textile filter cover overlying an obverse face of a planar array of multiple stand-off members, each of said stand-off members disposed in an unobstructed proximity with its adjacent member(s), and each said stand-off member comprising a plurality of spaced and axially aligned hoop configurations that are made of strong, substantially non-biodegradable material.

20. The system of claim 19, further comprising another membranous cover overlying a reverse face of said planar array.

21. The system of claim 20, wherein said another membranous cover is a geo-textile filter fabric.

22. The system of claim 20, wherein said another membranous cover is a non-permeable sheet.

23. A fluid collection and removal system comprising:

a drainage article that features a membranous, geo-textile filter cover overlying an obverse face of a planar array of multiple stand-off members, each of said stand-off members disposed in an unobstructed proximity with its adjacent member(s), and each said stand-off member comprising a plurality of spaced and axially aliened hoop configurations that are made of strong, substantially non-biodegradable material, wherein said hoop configurations in each said stand-off member is joined periodically, and is substantially orthogonal, to at least one longeron.

24. A fluid collection and removal system comprising:

a drainage article that features a membranous, geo-textile filter cover overlying an obverse face of a planar array of multiple stand-off members each of said stand-off members disposed in an unobstructed proximity with its adjacent member(s), and each said stand-off member comprising a plurality of spaced and axially aligned hoop configurations that are made of strong, substantially non-biodegradable material, wherein multiple said hoop configurations of at least one said stand-off member are parallel-interleaved with the hoop configurations of at least another one said stand-off member.

25. A fluid collection and removal system comprising:

a drainage article that features a membranous, geo-textile filter cover overlying an obverse face of a planar array of multiple stand-off members, each of said stand-off members disposed in an unobstructed proximity with its adjacent member(s), and each said stand-off member comprising a plurality of spaced and axially aligned hoop configurations that are made of strong, substantially non-biodegradable material, wherein multiple said hoop configurations of at least one said stand-off member are cross-linked with the hoop configurations of at least another one said stand-off member.

* * * * *

UNITED STATES PATENT AND TRADEMARK OFFICE

CERTIFICATE OF CORRECTION

PATENT NO. : 6,866,447 B1
DATED : March 15, 2005
INVENTOR(S) : Alton Parker

It is certified that error appears in the above-identified patent and that said Letters Patent is hereby corrected as shown below:

Title page,
Item [57], ABSTRACT,
Line 8, delete the words"cross-lining" and insert -- cross-linking --

Column 1,
Line 21, delete the words "to, effect" and insert -- to effect --

Column 5,
Line 6, delete "is is a" and insert -- is a --

Column 6,
Line 44, delete "(5) is another" and insert -- (5) another --

Column 7,
Line 24, delete "OIL" and insert -- O/L --

Column 8,
Line 30, delete "loon" and insert -- loop --
Line 50, delete "standoff" and insert -- stand-off --
Line 60, delete "stand-of" and insert -- stand-off --

Column 10,
Line 28, delete "members each" and insert -- members, each --

Signed and Sealed this

Thirty-first Day of May, 2005

JON W. DUDAS
*Director of the United States Patent and Trademark Office*